US006528470B1

(12) United States Patent
Ha et al.

(10) Patent No.: US 6,528,470 B1
(45) Date of Patent: Mar. 4, 2003

(54) BLEACHING ACTIVATOR

(75) Inventors: Kwang Ha, Daejeon (KR); Ki-Hwan Ko, Daejeon (KR); Chang-Hyun Jang, Daejeon (KR); Seon-Ho Shin, Daejeon (KR); Moon-Jeong Rang, Daejeon (KR); Kyu-Yeol Choi, Daejeon (KR); Jong-Ho Kim, Daejeon (KR)

(73) Assignee: LG Chemical Ltd., Seoul (KR)

( * ) Notice: Subject to any disclaimer, the term of this patent is extended or adjusted under 35 U.S.C. 154(b) by 0 days.

(21) Appl. No.: 09/701,855

(22) PCT Filed: Jun. 4, 1999

(86) PCT No.: PCT/KR99/00275

§ 371 (c)(1),
(2), (4) Date: Dec. 4, 2000

(87) PCT Pub. No.: WO99/64554

PCT Pub. Date: Dec. 16, 1999

(30) Foreign Application Priority Data

Jun. 5, 1998 (KR) ..... 98-20829
May 25, 1999 (KR) ..... 99-18840

(51) Int. Cl.[7] ..... C11D 7/38; C11D 7/54

(52) U.S. Cl. ..... 510/311; 510/315; 510/318; 510/372; 510/376; 510/378; 252/186.33

(58) Field of Search ..... 510/311, 315, 510/318, 372, 376, 378; 252/186.33

(56) References Cited

U.S. PATENT DOCUMENTS 5,362,421 A * 11/1994 Kropp et al. ..... 252/512
6,307,100 B1 * 10/2001 Richardson et al. ..... 562/543

FOREIGN PATENT DOCUMENTS

| | | | |
|---|---|---|---|
| EP | 0 869 171 A2 | 10/1998 | ..... C11D/3/395 |
| JP | 10-290690 | 11/1998 | ..... C12N/9/08 |
| WO | WO 97/39179 | 10/1997 | ..... D21C/9/10 |
| WO | WO 97/48787 | 12/1997 | ..... C11D/3/39 |

* cited by examiner

*Primary Examiner*—Gregory DelCotto
(74) *Attorney, Agent, or Firm*—Fish & Richardson P.C.

(57) ABSTRACT

The present invention provides a bleach activator for increasing the bleaching power of sodium percarbonate or sodium perborate and a bleaching composition including the same. The bleaching activator may be granulated, oil coated, or in capsulated form.

9 Claims, No Drawings

BLEACHING ACTIVATOR

CROSS REFERENCE TO RELATED APPLICATION

This application is based on application Numbers 98-20829 and 99-18840 filed in the Korean Industrial Property Office on Jun. 5, 1998 and May 25, 1999 respectively the content of which is incorporated hereinto by reference.

BACKGROUND OF THE INVENTION (a) Field of the Invention

The present invention relates to a bleaching activator and a bleaching composition comprising the same, particularly to a bleaching activator comprising a phenanthroline manganese complex and a bleaching composition comprising the same.

(b) Description of the Related Art

Inorganic peroxide (which generates hydrogen peroxide ($H_2O_2$) when dissolved in water) such as sodium perborate ($NaBO_3.H_2O$, $NaBO_3.4H_2O$) and sodium percarbonate ($2Na_2CO_3.3H_2O_2$), and hydrogen peroxide have been used as an oxidant for sterilizing or bleaching for a long time. The oxidizing power of these compounds in a dilute solution, that is, the bleaching power, is greatly depended on the temperature. For example, sufficient bleaching effects are obtained only after reaching a temperature of more than 80° C. when using sodium perborate or 60° C. when sodium percarbonate for bleaching textile soiled by fruit juice, wine, vegetables, coffee, or tea. Although the bleaching power of inorganic peroxide radically decreases at a temperature less than 60° C., this peroxide oxidizing power at a low temperature can be elevated by adding a material called a bleaching activator. Varieties of compounds of this material have been suggested in literature, and examples include acyl compounds such as tetraacetylethylenediamine (TAED), ester compounds such as nonanoyloxybenzenesulfonate (NOBS) and isononanoyloxybenzenesulfonate (ISONOBS), etc. Effects generated at 95° C. by peroxide alone can be generated at 60° C. if these materials are added. However, it is well known that at a temperature lower than 60° C. the activator effect is reduced drastically.

As there is a decreasing trend in washing and cleansing temperatures worldwide due to environmental protection and energy conservation, there is interest in the development of bleaching activators that can exhibit bleaching power at even low temperatures. Many transition metal ions are known to promote the decomposition of hydrogen peroxide ($H_2O_2$) or peroxide, so the use of transition metal salts has been suggested. However, a direct application of transition metal salts undesirably causes a bleaching agent to decomposed. Therefore, varieties of transition metal complexes have been developed for the purpose of a bleaching activation, and some of them have been used practically. These complex compounds should not decomposed drastically and should be stable during hydrolysis, oxidation, reduction, etc., so that the transition metal complexes can be used effectively as a bleaching catalyst.

Although a considerable large number of complex compounds (employing transition metals such as cobalt (Co), manganese (Mn), iron (Fe), etc.) have been developed recently, the use of cobalt is not desirable for environmental reasons. Therefore, a lot of patents have been recording the use of manganese. However, as manganese ions or many manganese complex compounds are very much unstable during hydrolysis, these compounds are not adequate to be used with inorganic peroxide bleaching agents.

It is recorded in European Laid-open Patent Numbers 458,397 B1 and 458,398 B1 that binuclear manganese complexes synthesized using a ligand of 1,4,7-trimethyl-1,4,7-triazacyclononane have a considerably high degree of activation in promoting the bleaching effect of peroxides even at the low temperature. However, there is a problem in that various steps must be used to synthesize this ligand, resulting in increasing the overall price of the ligand.

SUMMARY OF THE INVENTION

It is an object of the present invention to provide a bleaching activator comprising manganese complexes improving the bleaching activation of peroxide which is a hydrogen peroxide generating oxygen based bleaching agent considering the above mentioned problems of conventional technologies.

It is an other object of the present invention to provide a bleaching activator which is granulated, oil coated, or capsulated, and that increases the stability of the above manganese complex bleaching activators.

It is an another object of the present invention to provide a bleaching composition comprising the above manganese complex bleaching activators.

It is an another object of the present invention to provide a bleaching activator and a bleaching composition comprising the same that increase a bleaching power of bleaching agents used in laundry, dish washing, false teeth rinsing, and in industries such as fabrics, paper, and pulp.

It is an another object of the present invention to provide a bleaching agent and a bleaching detergent composition that are useful in an environment where a low temperature washing is prevalent, such as in Korea.

DETAILED DESCRIPTION OF THE PREFERRED EMBODIMENTS

In order to accomplish the above objects, the present invention provides a bleaching activator increasing the bleaching power of sodium percarbonate or sodium perborate, wherein the bleaching activator having a phenanthroline manganese complex comprising one or more compounds selected from a group including $[MnCl_2(phen)_2]$, $[MnBr_2(phen)_2]$, $[Mn(H_2O)_2(phen)_2](SO_4)$, $[Mn(H_2O)_2(phen)_2](ClO_4)_2$, $[Mn(CH_3COO)_2(phen)_2]$, $[Mn^{III}Cl_3(H_2O)(phen)]$, $[(phen)_2Mn^{IV}(\mu\text{-}O)_2Mn^{IV}(phen)_2](ClO_4)_4.H_2O$, $[(phen)_2Mn^{III}(\mu\text{-}O)_2Mn^{IV}(phen)_2](ClO_4)_3.xH_2O$ (where x=2 or 4), and $[(phen)(H_2O)Mn^{III}(\mu\text{-}O)(\mu\text{-}CH_3COO)_2Mn^{III}(phen)(H_2O)](PF_6)_2$.

The above phenanthroline manganese complex can be used itself, but is preferably used in a granulated, oil coated, or capsulated form.

The above granulated bleaching activator is manufactured by mixing a) 100 to 1000 weight parts of binder; b) 110 to 3000 weight parts of filler; and c) 100 to 1000 weight parts of a mixed solution of the above phenanthroline manganese complex compound powder and a photo-bleaching agent solution (comprising 0.1 to 20 wt % of photo-bleaching agent).

The above oil coated bleaching activator is manufactured by coating phenanthroline manganese complex granules with oil in water emulsion composition.

The above capsulated bleaching activator is manufactured by coating 1000 weight parts of oil coated phenanthroline manganese complex granules with 100 to 3000 weight parts of a mixture of water soluble materials, photo-bleaching agent or fluorescent dye.

Furthermore, the present invention provides a bleaching composition comprising a bleaching activator comprising the above phenanthroline manganese complex.

Particularly, the above bleaching composition is a peroxide bleaching agent comprising:

a) 0.001 to 5 wt % of a bleaching activator comprising the above manganese based phenanthroline manganese complex; and b) 1 to 99 wt % of sodium percarbonate peroxide or sodium perbonate peroxide, or a bleaching detergent comprising:

a) 1 to 40 wt % of peroxide;

b) 1 to 50 wt % of anion surfactant;

c) 1 to 50 wt % of non ion surfactant;

d) 1 to 70 wt % of builder;

e) 0.1 to 10 wt % of tetraacetylethyleneamine; and f) 0.0001 to 0.5 wt % of bleaching activator comprising the above manganese based phenanthroline manganese complex, or, the above bleaching composition is a false teeth rinsing agent comprising:

a) 1 to 70 wt % of peroxide comprising one or more selected from a group composed of urea peroxide, sodium percarbonate, sodium perbonate, and calcium peroxide;

b) 0.001 to 10 wt % of bleaching activator comprising the above manganese based phenanthroline manganese complex; and c) additives comprising a bubbling agent, wetting agent, viscosity increasing agent, and abradant.

And the above bleaching activator comprising a phenanthroline manganese complex compound is granulated, oil coated, or capsulated phenanthroline manganese complex.

The present invention is described in detail as follows:

The inventors of the present invention found that a series of phenanthroline manganese complexes could explicitly promote the effects of a bleaching agent peroxide using a relatively inexpensive ligand such as phenanthroline (1,10-phenanthroline; abbreviated as phen). These phenanthroline manganese complexes are relatively easily synthesized, quite stable in hydrolysis, oxidation, reduction, etc., and have excellent performance compared to their price.

The above manganese complexes are stable even in a basic solution and they are catalysts which activate the peroxide bleaching effect on red wine or coffee, etc., even at a low temperature. Therefore, the present invention is characterized in that during the bleaching or cleansing using a bleaching agent such as a hydrogen peroxide generating inorganic peroxide, peroxy-acid, and its salt, the bleaching agent becomes activated by the above listed compounds with small amounts of bleaching agent added.

Generally, bleaching agent is a solid phase, used by being dissolved in water, with this bleaching agent's aqueous solution being most effective in the pH range of 8 to 11. The effective amount of manganese complex is generally indicated in the amount of manganese in an aqueous solution of bleaching agent, generally being in the range of 0.001 to 50 ppm. High concentrated contents can be used in the industrial processes such as the bleaching fabric, paper, and pulp, and a small amount can be used in laundry or dish washing and the rinsing of a false teeth.

Another characteristic of the present invention is to provide a bleaching agent composition comprising a manganese based content of 0.0001 to 5 wt % (preferably 0.001 to 1 wt %) as a catalyst for activating a 1 to 99 wt % of peroxide and one of the above listed phenanthroline manganese complex compounds. At this time, additives such as surfactant, zeolite, sodium carbonate, sodium sulfate, enzyme, fragrance, etc., can be added depending on the situation for a prevention of recontamination, all types of stability, and bleaching agent performance.

Supplying sources generating a hydrogen peroxide includes inorganic peroxides such as alkali metal perborate, percarbonate, perphosphate, and persulfate, organic peroxides such as urea peroxide, and alkali metal peroxides. Particularly, bleaching materials suitable for washing are sodium percarbonate, sodium perborate monohydrate, and sodium perborate tetrahydrate. Sodium perborate monohydrate is preferable as it has more superior storage stability and is dissolved more quickly than sodium perborate tetrahydrate. Although sodium percarbonate has an advantage in its environment friendly aspects, its stability is lower than that of sodium perborate. For the purpose of bleaching, two or more of these compounds can be mixed and used. Furthermore, these bleaching agents can be used along with peroxy-acid bleaching agent precursor, the use of precursor not only increases bleaching effect, but also has a disinfection effect resulting in hygienic advantages. Organic peroxy-acid can also be used as a peroxide.

One of characteristics of the present invention is to provide a bleaching detergent composition comprising of one of the phenanthroline manganese complexes such as peroxide, anion surfactant, non ionic surfactant, one or more of builders, tetraacetylethyleneamine (TAED), and a bleaching activation catalyst.

A bleaching detergent composition in the present invention comprises 1 to 50 wt % (preferably 5 to 35 wt %) of peroxide. It can also comprise a 0.1 to 25 wt % (preferably 1 to 10 wt %) of tetraacetylethylenediamine (TAED). In the case where it comprises a phenanthroline manganese complex, 0.0001 to 0.5 wt % (preferably 0.001 to 0.3 wt %) of manganese content out of a detergent composition can be mixed.

An anionic or non ionic surfactant can be used as the above surfactant. Total content of surfactant is 1 to 50 wt % (preferably 10 to 40 wt %) of composition. One or more compounds selected from alkylbenzene sulfonates, fatty acid salts, alkane monosulfonates, and olefinsulfonates can be used as an anionic surfactant, and one or more compounds selected from oxo-alcohol polyethyleneglycolethers, fatty acid alkanol amides, and ethoxylated alkanes can be used as a non ionic surfactant.

Materials used as a builder include alkalimetal polyphosphates such as sodium tripolyphosphates, alumino silicates such as zeolites, polyacetalcarboxylates, polycarboxylates, etc. A 1 to 70 wt % (preferably 10 to 40 wt %) of builder is used.

Besides the above materials, a bleaching detergent composition of the present invention can use inorganic salts such as sodium carbonate, sodium sulfate, etc., which generally can be used as a powder detergent, and polymers as additives to lower water hardness and prevent recontamination. Furthermore, additives such as fluorescent agent, enzymes, and fragrance can be used to increase the performance of a detergent.

The another characteristics of the present invention is to provide a composition of a false teeth rinsing agent comprising one or more items selected from a group including generally used peroxide, a bubbling agent, wetting agent, viscosity increasing agent, abradant, and the above phenanthroline manganese complex.

The above composition of a false teeth rinsing agent uses 0.01 to 70 wt % (preferably 0.1 to 30 wt %) of peroxide (hydrogen peroxide/total of rinsing agent) comprising one or more compounds selected from a group composed of urea peroxide, sodium percarbonate, sodium perborate, and calcium peroxide. 0.001 to 10 wt % (preferably 0.005 to 7 wt %) of a phenanthroline manganese complex (manganese content/total composition of a false teeth rinsing agent) can be used.

Peroxides and bleaching activators used in the present invention are solid particles, and can be used in a detergent in a powder or granule type form manufactured by already known technologies. It can be manufactured by adding peroxides and phenanthroline manganese complex to powder detergent manufactured using processes of spray drying, non-tower type, extrusion, granulation, and concentration.

The another characteristics of the present invention is to provide conditions of granulization, oil coating, and capsulation to increase the stability of the bleaching activator's product. A phenanthroline manganese complex powder is preferably used as a bleaching activator. Manganese salts are replaced with phenanthroline among ethyl alcohol, phenanthroline manganese complex (which is not dissolved by ethyl alcohol) is separated, the excess amount of non reacted materials is removed by cleaning with ethyl alcohol, then it is dried and crushed turning the phenanthroline manganese complex into powder. A phenanthroline manganese complex manufactured as per this method is preferrably used by separating the peroxide bleaching agent and other constituents. It is accomplished through the granulation, oil coating, and capsulation processes of compound.

In granulation, granules similar to spheres can be manufactured using Lödige mixer or extruder, binder comprising one or more items selected from sugar, sodium silicate, polyethyleneglycol, fatty acid salts, hydroxypropylmethylcellulose, cellulose, Arabic gum, ethyleneoxide based non ionic surfactant, and polyvinylpyrrolidone can be used, the filler, which is mixed with the binder, includes one or more out of Zeolite 4A, X, Y, L, P, omega, zeolone modernite, ZSM-5, F, W, ethylenediamine tetraacetic acid (EDTA), and sodium ethylenediaminetetraacetate. At this time, photo-bleaching agents should be used along with binders and fillers to prevent color changes caused by metal oxidation. Any photo-bleaching agents that are normally used in the technology fields of the present invention can be used.

In performing the granulation process, after 1000 wt parts of filler, 100 to 1000 wt parts (preferably 200 to 600 wt parts) of binder, and 100 to 1000 wt parts (preferably 100 to 500 wt parts) of powder type complex were first put into a Lödige mixer, premixing is performed. When compounds of filler and binder have been uniformly mixed, with only a main blade operated, a top lid of the mixer was opened, and 100 to 1000 wt parts (preferably 100 to 500 wt parts) of photo-bleaching solution (0.1 to 20 wt % (preferably 0.1 to 10 wt %) of photo-bleaching agent per total weight of solution is used) was added, the lid was then closed, and the cross screw operated. When particles are grown to the appropriate sizes, 100 to 2000 wt parts (preferably 200 to 1000 wt parts) of fillers are put into one to 5 times completing the granulation. Therefore, total amount of fillers used is 1100 to 3000 wt parts, and the size of the final granules manufactured according to this method 100 to 3000 $\mu$m, preferably 200 to 2000 $\mu$m.

Stabilization of the moisture content of granuled bleaching activators can be increased by forming a hydrophobic layer of thin oil coating before capsulation. Oil coating is made using oil in water emulsion, oil in water emulsion is composed of 5 to 50 wt parts of oil and 50 to 95 wt parts of water. Oil can be used comprising one or more substances selected from a group including silicone oil with a viscosity of 100 to 5,000 centistokes (cst), a mixture of 70 to 90 wt % silicone oil with a viscosity of 100 to 5,000 cst and silicone oil with a viscosity of 10,000 to 100,000 cst, a mixture of 95 to 99.5 wt % silicone oil with a viscosity of 100 to 5,000 cst and 0.1 to 5 wt % wax, liquid paraffin, soybean oil, olive oil, and sesame oil. Oil in water emulsion comprises 0.5 to 30 wt % of emulsifiers, with typical emulsifiers including soap or polyoxyethylenesorbitan monostearates.

In the oil coating performing process, 1000 wt parts of granules are put into fluidized bed, with the equipment operated, 20 to 1000 wt parts (preferably 20 to 500 wt parts) of coating materials are sprayed through a spray nozzle at an upper or a lower part of a container fuidizing the granules with hot air. Hot air temperature inside the fluidized bed is maintained between 60° C. to 200° C., and preferably between 60° C. to 100° C.

The oil coated bleaching activator granules can be capsulated continuously in the same fluidized bed. Capsulation is performed using water soluble materials combined with photo-bleaching agent and/or fluorescent whitening agents. Usable water soluble materials that can be used are one or more items selected from a group including albumin, gelatin, Arabic gum, agaroses, alginates, cellulose, celluloseacetatephthalates, methylcelluloses, ethylcelluloses, hydroxypropylcelluloses, polyvinylalcohols, polyvinylpyrrolidones, silicone polymers, soluble starches, dextrins, fatty acid salts, fatty acids, fatty alcohols, chitosan, and a photo-bleaching agent and fluorescent dyes capable of being mixed with water soluble materials and which are commonly employed in the technology fields of the present invention. A photo-bleaching agent is preferably Timolux DBS of CIBA Corporation, fluorescent dyes preferably include Tinopal CBS-X(disodium-4,4'-bis(2-sulfostyryl) biphenyl; CIBA) or CBW (disodium- 4,4'-bis{[4-anilino-6-(N-ethyl-N-2-hydroxyethyl)amino-1,3,5-triazin-2-yl]amino}stilbene-2,2'-disulfonate; Kyung-in Synthetics Corporation). An aqueous solution having the concentrations of 2 to 50 wt % (preferably 5 to 30 wt %) of water soluble material, 0.1 to 20 wt % (preferably 0.1 to 10 wt %) of photo-bleaching agent, and 1 to 50 wt % (preferably 1 to 30 wt %) of fluorescent dye are manufactured and used. Either a photo-bleaching agent and/or fluorescent dye can be used.

A capsulation process can be performed by putting 1000 wt parts of oil coated granules into a fluidized bed. The granules are fluidized by hot air with the fluidized bed operation, and 100 to 3000 wt parts (preferably 100 to 2000 wt parts) of capsulated material, i.e., an aqueous solution comprising water soluble material combined with a photo-bleaching agent and/or fluorescent dye is sprayed through a spray nozzle at side or lower part of container. Hot air is maintained at a temperature of between 50° C. to 200° C., preferably between 50° C. to 100° C., the size of capsulated bleaching activator manufactured according to this is controlled to be within the range of 200 to 4000 $\mu$m, preferably 300 to 3000 $\mu$m. The size of capsulated bleaching activator can be controlled depending on the amount of capsulated materials, and reaction conditions such as temperature, spraying rate, flow volume of air, etc. Therefore, by combining these conditions properly, desired sized capsules can be obtained.

The present invention is described in detail through the below EXAMPLES and COMPARATIVE EXAMPLES. However, these EXAMPLES are for illustrating the present invention and not for limiting the present invention.

EXAMPLE 1

Synthesis of $[MnCl_2(phen)_2]$

After 1.82 g (10.10 mmol) of 1,10-phenanthroline (phen) were dissolved in 20 ml of acetone, 10 ml of aqueous solution, in which 1.0 g (5.05 mmol) of $MnCl_2.4H_2O$ had been dissolved, was added in this solution under agitating conditions forming a yellow precipitate. This mixture was agitated for about two hours, and 50 ml of acetone was further added, and then the precipitates were filtered. Afterward, the precipitates were washed with acetone and dried to obtain 2.20 g of $[MnCl_2(phen)_2]$.

Mass analysis (FAB): m/e 450, 452 $MnCl(phen)_2^+$; 415 $Mn(phen)_2^+$; 270, 272 $MnCl(phen)^+$(typical block ions were written here);

IR ($cm^{-1}$): 3441 (br), 3050, 1510,1421, 857, 853, 729, 720, 634; Melting point: it did not melted at 350° C.

EXAMPLE 2

Synthesis of $[MnBr_2(phen)_2]$

After 1.67 g (9.27 mmol) of 1,10-phenanthroline were dissolved in 20 ml of acetone, 10 ml of aqueous solution, in which 0.99 g (4.61 mmol) of $MnBr_2$ had been dissolved, was added in this solution under agitating conditions forming a yellow precipitate. This mixture was agitated for about two hours, and 20 ml of ether was added, and then the precipitates were filtered. Afterward, the precipitates were washed with acetone and dried to obtain 2.45 g of $[MnBr_2(phen)_2]$.

Mass analysis (FAB): m/e 494, 496 $MnBr(phen)_2^+$; IR ($cm^{-1}$): 3441 (br), 3046, 1516, 1427, 864, 845, 728, 638; Melting point: it did not melted at 350° C.

EXAMPLE 3

Synthesis of $[Mn(H_2O)_2(phen)_2](SO_4)$

After 1.67 g (9.27 mmol) of 1,10-phenanthroline were dissolved in 20 ml of acetone, 10 ml of aqueous solution, in which 1.11 g (4.60 mmol) of $MnSO_4.5H_2O$ had been dissolved, was added in this solution under agitating conditions forming a yellow precipitate. This mixture was agitated for about two hours, and then the precipitates were filtered. Afterward, the precipitates were washed with acetone and dried to obtain 2.27 g of $[Mn(H_2O)_2(phen)_2](SO_4)$.

Mass analysis (FAB): m/e 512, $Mn(phen)_2(HSO_4)_2^+$; IR ($cm^{-1}$): 3374, 3238 (br), 3061, 1516, 1426, 1109(br), 864, 849, 729, 619; Melting point: it did not melted at 350° C.

EXAMPLE 4

Synthesis of $[Mn(H_2O)_2(phen)2](ClO_4)_2$

After 1.67 g (9.27 mmol) of 1,10-phenanthroline were dissolved in 20 ml of acetone, 10 ml of aqueous solution, in which 1.67 g (4.61 mmol) of $Mn(ClO_4)_2.6H_2O$ had been dissolved, was added in this solution under agitating conditions forming a yellow precipitate. This mixture was agitated for about two hours, 60 ml of ether was added, and then the precipitates were filtered. Afterward, the precipitates were washed with acetone and dried to obtain 2.97 g of $[Mn(H_2O)_2(phen)_2](ClO_4)_2$.

Mass analysis (FAB): m/e 514, 516 $Mn(phen)_2(ClO_4)^+$; IR ($cm^{-1}$): 3502 (br), 3065, 1519, 1426, 1145, 1097, 1084, 866, 847, 726, 623; Melting point: 380° C. (it began decomposing from 370° C.).

EXAMPLE 5

Synthesis of $[Mn(CH_3COO)_2(phen)_2]$

After 1.67 g (9.27 mmol) of 1,10-phenanthroline and 1.13 g (4.61 mmol) of $(CH_3COO)_2Mn.4H_2O$ were dissolved in 30 ml of ethanol, the mixture was agitated for about one hour, and then the solvent was evaporated. Afterward, the yellow precipitate was washed with ether and acetone and then dried to obtain 2.29 g of $[Mn(CH_3COO)_2(phen)_2]$.

Mass analysis (FAB): m/e 474, $Mn(CH_3COO)\ (phen)_2^+$; IR ($cm^{-1}$): 3416 (br), 3051, 1595, 1514, 1427, 1417, 1377, 1328, 851, 730, 722, 636; Melting point: it decomposed at 245° C.

EXAMPLE 6

Synthesis of $[Mn^{III}Cl_3(H_2O)(phen)]$

The above compound was synthesized according to the literature ('H. A. Goodwin, R. N. Sylva, Aust. J. Chem., 1965, 18, p 1743–1749).

After a 5 g (31.6 mmol) of $KMnO_4$ were dissolved by adding a small amount of it to 50 ml of 10 N HCl solution and agitating, this mixture was left at room temperature for about 10 minutes until all reactions had finished. This black brown solution was filtered once, then it was slowly added to 30 ml of 10 N HCl solution, in which 2.0 g (11.1 mmol) of 1,10-phenanthroline had been dissolved. After the formed reddish brown precipitates were filtered, washed with first 50 ml of 5 N HCl solution and then with acetone, and dried, 3.71 g of a reddish brown compound were obtained.

Mass analysis (FAB): m/e 270, 272 $MnCl(phen)^+$; IR ($cm^{-1}$): 3491, 3307, 3055, 1518, 1422, 861, 718, 653; Melting point: it began decoloring from 160° C.

EXAMPLE 7

Synthesis of $[(phen)_2Mn^{III}(\mu\text{–}0)_2Mn^{IV}(phen)_2](ClO_4)_4.H_2O$ The above compound was synthesized according to the literature ('H. A. Goodwin, R. N. Sylva, Aust. J. Chem., 1967, 20, p 629–637).

After a 1.82 g (10.10 mmol) of 1,10-phenanthroline were dissolved in 150 ml of distilled water that was heated somewhat and to which 5 drops of 10 N HCl were added, 2.0 g (5.56 mmol) of $[MnCl_3(H_2O)(phen)]$ were added to the above solution. Afterwards, the black brown solution that was formed was filtered once, and slowly added to a cold mixed solution of 50 ml $HClO_4$ (60%) and 50 ml $H_2O$ by agitating the filtered solution. After the formed black reddish brown precipitates were filtered, washed with ethanol and then with ether, and dried, 2.11 g of binuclear manganese (IV, IV) complex compound were obtained.

Mass analysis (FAB): m/e 514, 516 $Mn(phen)_2(ClO_4)^+$; IR ($cm^{-1}$): 3448(br), 3098, 1543, 1519, 1427, 1106, 1091, 848, 718, 657, 624; Melting point: it began melted from 285° C. (it changed color at the melting point).

EXAMPLE 8

Synthesis of $[(phen)_2Mn^{III}(\mu\text{–}0)_2Mn^{IV}(phen)_2](ClO_4)_3.xH_2O$ (where x=2, 4).

The above compound was synthesized according to the literature ('R. on, V. Riera, M. A. Ciriano, Transition Met. Chem., 1976, 1, p 98–99).

A 30 ml of MeOH solution, in which 1.68 g (9.32 mmol) of 1,10-phenanthroline were dissolved, was added to 1.0 g (3.73 mmol) of $(CH_3COO)_3Mn.2H_2O$ and agitated. A mixed solution of 1.2 ml 60% $HClO_4$/10 ml MeOH was added to the above reddish brown solution, and then olive colored precipitates were formed right away. After these precipitates were filtered, washed with $MeOH/H_2O$ and then with ether, and dried, 1.56 g of nuclear manganese (III, IV ) complex compound were obtained.

Mass analysis (FAB): m/e 514, 516 $Mn(phen)_2(ClO_4)^+$; IR ($cm^{-1}$): 3424(br), 3067, 1519, 1426, 1146, 1090, 847, 719, 691, 624; Melting point: about 325° C. (decomposition: it changed color below the melting point)

EXAMPLE 9

Synthesis of $[(phen)(H_2O)Mn^{III}(\mu\text{–}0)\ (\mu\text{–}CH_3COO)_2\ Mn^{III}(phen)\ H_2O)](PF_4)_2$ The above compound was synthesized according to the literature ('S. enage, J.-J. Girerd, A. Gleizes, J. Chem. Soc., Chem. Commun., 1988, p 431–432).

A 3 ml solution of 99% $CH_3COOH$, 0.079 g (0.50 mmol) of $KMnO_4$/2.5 ml of $H_2O$ , and 0.45 9 (2.50 mmol) of 1,10-phenanthroline were added to 30 ml of MeOH solution, in which 0.49 g (2.0 mmol) of $(CH_3COO)_2Mn.4H_2O$ were dissolved, and agitated for 15 minutes. 0.48 g (2.86 mmol) $NaPF_6$/2.5 ml of $H_2O$ were added to this black brown solution and agitated, and then black brown colored precipitates gradually formed. After these precipitates were filtered, cleaned with MeOH, and dried, 1.53 g of binuclear manganese (III, III) complex compound were obtained.

Mass analysis (FAB): m/e 415 $Mn(phen)_2^+$; IR ($cm^{-1}$): 3442(br), 3091, 1586, 1519, 1428, 1342, 843, 723, 558; Melting point: about 345° C. (it decomposed below the melting point).

EXAMPLE 10

Evaluation of Bleaching Activating Power on the Solution of Compounds Manufactured at EXAMPLE 1 to 9

Bleaching activating performance of the phenanthroline manganese complex compounds of the above EXAMPLE 1 to 9 were measured using the test solutions of red wine, morin, and coffee.

1 g of sodium percarbonate was dissolved in 500 ml of tap water. Respective manganese complexes were dissolved in a mixture of 100 ml of red wine and 400 ml of water, and to this solution was added a sodium percarbonate solution. As morin does not dissolve in water well, 0.020 g of morin were dissolved in 2.5 ml of ethanol first, and then this was added to 500 ml of water, afterwhich the manganese complex was dissolved. In the case of coffee, 0.1 g of coffee were dissolved in 500 ml of water.

Complexes which would be inspected were used so that the concentration would be $2\cdot10^{-5}$ mol/l in the red wine against manganese metal case, and $10^{-5}$ mol/l of concentration when using coffee and morin solution.

Absorbance A of the solution was measured at wavelengths of 500 nm (red wine), 415 nm (morin), or 400 nm (coffee) each for 5 minutes over a 30 minute period.

In order to compare with the bleaching activity powers of each phenanthroline manganese complexes, a blank solution (a solution in which only the test solution and sodium percarbonate were added) and a solution in which 0.1 g to 0.2 g of tetraacetylethylenediamine (TAED) were dissolved were evaluated, and the remainder was evaluated under the same conditions.

Test results were represented in Tables 1, 2, and 3 as a decoloration ratio D(t) calculated according to the below Formula 1. Therefore, the higher values indicate greater decoloration and more superior bleaching activation performance.

$$D(t)=[A(o)-A(t)]/A(o)\times100 \quad \text{[Formula 1]}$$

From the above Formula,

D(t) is decoloration ratio (%),

A(o) is absorbance before decoloration, and

A(t) is absorbance after decoloration.

The results of Table 1 showed that there were no bleaching effects when using only sodium percarbonate on red wine, and the decoloration effect was much less as 4 to 5% even when using 0.1 g to 0.2 g of tetraacetylethylenediamine (TAED), while the bleaching effects were far superior when using a phenanthroline manganese complex as a bleaching activator.

The results of Table 2 showed that a phenanthroline manganese complex is a very much more effective bleaching activator on a pigment compound such as morin. A phenanthroline manganese complex of EXAMPLE 9 presented a low decoloration effect as its solubility in water was low.

The results of Table 3 shows that a phenanthroline manganese complex presents much superior effects even for the decoloration of coffee solutions than does the case of using much higher concentrated tetraacetylethylenediamine (TAED).

TABLE 1

Performance evaluation of bleaching activators using red wine

| Compositions of bleaching activators | Decoloring ratio per time D(t) (%) | | | |
|---|---|---|---|---|
| | 5 minutes | 10 minutes | 20 minutes | 30 minutes |
| Non content | 0 | 0 | 0 | 0 |
| TAED 0.1 g | 0 | 2 | 3 | 4 |
| TAED 0.2 g | 0 | 1 | 4 | 5 |
| EXAMPLE 1 | 7 | 13 | 22 | 29 |
| EXAMPLE 2 | 9 | 13 | 25 | 32 |
| EXAMPLE 3 | 7 | 14 | 24 | 31 |
| EXAMPLE 4 | 7 | 15 | 30 | 38 |
| EXAMPLE 5 | 17 | 29 | 42 | 49 |
| EXAMPLE 6 | 9 | 16 | 27 | 35 |
| EXAMPLE 7 | 13 | 25 | 41 | 49 |
| EXAMPLE 8 | 5 | 13 | 34 | 50 |
| EXAMPLE 9 | 14 | 35 | 56 | 63 |

The above measurements were taken under the conditions of sodium percarbonate 1 g; red wine 100 ml+water 900 ml; concentration of Mn $2\cdot10^{-5}$ mol/l; $\lambda$=500 nm; pH=9.6; and a temperature of 12° C.

TABLE 2

Performance evaluation of bleaching activators using morin

| Compositions of bleaching activators | Decoloring ratio per time D(t) (%) | | | |
|---|---|---|---|---|
| | 5 minutes | 10 minutes | 20 minutes | 30 minutes |
| non content | 4 | 8 | 14 | 20 |
| TAED 0.1 g | 3 | 7 | 15 | 21 |
| TAED 0.2 g | 5 | 11 | 22 | 32 |
| EXAMPLE 1 | 72 | 89 | 91 | 91 |
| EXAMPLE 2 | 68 | 88 | 91 | 91 |
| EXAMPLE 3 | 60 | 87 | 91 | 91 |
| EXAMPLE 4 | 27 | 60 | 90 | 91 |
| EXAMPLE 5 | 71 | 89 | 91 | 91 |
| EXAMPLE 6 | 63 | 86 | 91 | 91 |
| EXAMPLE 7 | 60 | 87 | 91 | 91 |
| EXAMPLE 8 | 34 | 60 | 89 | 91 |
| EXAMPLE 9 | 7 | 14 | 24 | 33 |

The above measurements were taken under the conditions of sodium percarbonate 1 g; morin 0.02 g/ethanol 2.5 ml+water 1000 ml; a concentration of Mn $10^{-5}$ mol/l; $\lambda$=415 nm; pH=10.5; and a temperature of 12° C .

TABLE 3

Performance evaluation of bleaching activators using coffee

| Compositions of bleaching activators | Decoloring ratio per time D(t) (%) | | | |
|---|---|---|---|---|
| | 5 minutes | 10 minutes | 20 minutes | 30 minutes |
| Non content | 5 | 9 | 16 | 23 |
| TAED 0.1 g | 8 | 20 | 55 | 59 |
| TAED 0.2 g | 12 | 33 | 59 | 61 |
| EXAMPLE 1 | 31 | 43 | 53 | 57 |
| EXAMPLE 2 | 28 | 42 | 53 | 57 |
| EXAMPLE 3 | 31 | 45 | 55 | 59 |
| EXAMPLE 4 | 21 | 37 | 51 | 58 |
| EXAMPLE 5 | 45 | 55 | 60 | 62 |
| EXAMPLE 6 | 32 | 47 | 57 | 61 |
| EXAMPLE 7 | 34 | 50 | 59 | 62 |

TABLE 3-continued

Performance evaluation of bleaching activators using coffee

| Compositions of bleaching activators | Decoloring ratio per time D(t) (%) | | | |
|---|---|---|---|---|
| | 5 minutes | 10 minutes | 20 minutes | 30 minutes |
| EXAMPLE 8 | 19 | 37 | 55 | 59 |
| EXAMPLE 9 | 9 | 17 | 31 | 41 |

The above measurements were taken under the conditions of sodium percarbonate 1 g; coffee 0.10 g/water 1000 ml; a concentration of Mn $10^{-5}$ mol/l; A=400 nm; pH=10.5; and temperature of 12° C.

EXAMPLE 11, COMPARATIVE EXAMPLE 1

Evaluation of Bleaching Activating Power of a Bleaching Activator of EXAMPLE 1 on Contaminated Cloth Contaminated cloth was immersed and cleaned for 30 minutes with a bleaching agent and a sample in which $[MnCl_2(phen)_2]$ (the complex compound of EXAMPLE 1) was added to this bleaching agent that had been put into one liter of distilled water and dissolved by agitation for one minute. The temperature of this solution was maintained at 20° C. by using a Terg-O-Tometer.

After the stained cloths were dried naturally, the WB value was measured using a color difference meter (NIPPON DENSHOKU 300A), and bleaching power was calculated by substituting WB values before and after cleaning into the Kubelka-Munk Formula. The higher value of bleaching power means more superior bleaching power.

In EXAMPLE 11, the bleaching power was measured on cloths stained by tea, red wine, coffee, and spinach with a bleaching agent A (containing 90% or more sodium percarbonate and 1% of TAED) not comprising a bleaching activator of COMPARATIVE EXAMPLE 1 and a sample, in which the complex compound of EXAMPLE 1 was added to bleaching agent A. Detailed test conditions and evaluation results are presented in Table 4.

TABLE 4

Compositions of test samples and bleaching powers on the contaminated cloths with tea, red wine, coffee, and spinach

| Samples | Bleaching agent [g] | Bleaching activator [g] | Washing Power [%] (tea) | Washing power [%] (red wine) | Washing power [%] (coffee) | Washing power [%] (spinach) |
|---|---|---|---|---|---|---|
| COMPARATIVE EXAMPLE 1 | 5.00 | 0 | 37 | 78 | 47 | 76 |
| EXAMPLE 11 | 5.00 | 0.01 | 70 | 89 | 62 | 87 |

The results of Table 4 showed that EXAMPLE 11, to which a phenanthroline manganese complex of EXAMPLE 1 was added presented a more superior bleaching effect when compared to COMPARATIVE EXAMPLE 1 that used only a bleaching agent. Therefore, it can be seen that a phenanthroline manganese complex used as a bleaching activator has much superior performance as an activating bleaching agent.

EXAMPLE 12, 13, COMPARATIVE EXAMPLE 2, 3

Bleaching power was evaluated using the same methods as EXAMPLE 11 and COMPARATIVE EXAMPLES 2 and 3 with samples of which a bleaching agent B (comprising 75% of sodium percarbonate and 2% of TAED) and a bleaching agent C (comprising 75% of sodium percarbonate) did not include bleaching activators such as COMPARATIVE EXAMPLES 2 and 3, respectively, and samples of which $[MnCl_2(phen)_2]$ (complex compound of EXAMPLE 1) were added to bleaching agent B and bleaching agent C as EXAMPLES 12 and 13, respectively, as shown in Table 5. Detailed test conditions and evaluation results are presented in Table 5.

TABLE 5

Compositions of test samples and bleaching powers on the contaminated cloths with tea, red wine, coffee, and spinach

| Samples | Bleaching Agent [g] | Bleaching activator [g] | Washing power [%] (tea) | Washing power [%] (red wine) | Washing power [%] (coffee) | Washing power [%] (spinach) |
|---|---|---|---|---|---|---|
| COMPARATIVE EXAMPLE 1 | A 5.00 | 0 | 39 | 78 | 37 | 79 |
| COMPARATIVE EXAMPLE 2 | B 5.00 | 0 | 66 | 93 | 88 | 82 |
| COMPARATIVE EXAMPLE 3 | C 5.00 | 0 | 64 | 90 | 90 | 81 |
| EXAMPLE 12 | B 5.00 | 0.01 | 87 | 98 | 100 | 90 |
| EXAMPLE 13 | C 5.00 | 0.01 | 87 | 97 | 100 | 90 |

The results of Table 5 showed that bleaching powers of bleaching agents B and C (COMPARATIVE EXAMPLES 2 and 3) were superior to bleaching agent A (COMPARATIVE EXAMPLE 1), and EXAMPLES 12 and 13 using bleaching agents B or C. Additionally, phenanthroline manganese complexes had far more excellent bleaching effects than COMPARATIVE EXAMPLES 2 or 3 using only bleaching agents B and C, respectively.

EXAMPLE 14 TO 16

Granulation of Bleaching Activators

After Zeolite and binder were put into a Lödige mixer, premixing was performed. When it was uniformly mixed, the upper lid of the mixer was opened and a mixed solution of a phenanthroline manganese complex synthesized in EXAMPLE 1 and a photo-bleaching agent was poured into it when the main blade only was operating, and then the lid was closed and cross screws operated to perform granulation. When particles were grown to the appropriate sizes, Zeolite powder was put into one to five times to complete granulation. Fillers used in the granulation, binder composition, concentration, and detailed test conditions are represented in Table 6.

TABLE 6

| Classification | Granulation conditions EXAMPLE 14 | EXAMPLE 15 | EXAMPLE 16 |
|---|---|---|---|
| EXAMPLE 1 Complexes | powder 150 | powder 150 | powder 300 |
| Filler | Zeolite 429 | EDTA-4Na 750 | Zeolite 279 |
| Powder phase binder | Sugar 288<br>PVP 28 | Sugar 288<br>PVP 28 | Sugar 288<br>PVP 28 |

TABLE 6-continued

| Classification | Granulation conditions EXAMPLE 14 | EXAMPLE 15 | EXAMPLE 16 |
|---|---|---|---|
| Liquid phase binder | water 72 | water 80 | Water 72 |
| Subsequent filler | Zeolite 351 | EDTA-4Na 316 | Zeolite 351 |
| Subsequent powder phase binder | Sugar 136 | Sugar 35 | Sugar 136 |
| Subsequent liquid phase binder | water 48 | water 40 | water 48 |
| rotation speed of main blade (rpm) | 100 | 90 | 110 |
| Rotation speed of main blade (rpm) | 3600 | 3000 | 3500 |
| Additional number of subsequent materials | 2 | 2 | 2 |

EXAMPLE 17

Bleaching Performance Evaluation of the Granulated Bleaching Activators

As described in Table 7, a bleaching agent A (COMPARATIVE EXAMPLE 1), a bleaching agent C (COMPARATIVE EXAMPLE 3), a sample into which a phenanthroline manganese complex of EXAMPLE 1 was added to bleaching agent C (EXAMPLE 13), and a sample into which a bleaching activator of the above EXAMPLE 14 granuled using zeolite 4A as filler was added to bleaching agent C (EXAMPLE 17) were evaluated using the test method written in EXAMPLE 11. The detailed test conditions and evaluation results are represented in Table 7.

TABLE 7

Compositions of test samples and bleaching powers on the contaminated cloths with tea, red wine, coffee, and spinach

| Samples | Bleaching Agent [g] | Bleaching activator [g] | Washing power [%] (tea) | Washing power [%] (red wine) | Washing power [%] (coffee) | Washing power [%] (spinach) |
|---|---|---|---|---|---|---|
| COMPARATIVE EXAMPLE 1 | 5.00 | — | 36 | 76 | 42 | 75 |
| COMPARATIVE EXAMPLE 3 | 5.00 | — | 61 | 91 | 81 | 77 |

TABLE 7-continued

Compositions of test samples and bleaching powers on the contaminated cloths with tea, red wine, coffee, and spinach

| Samples | Bleaching Agent [g] | Bleaching activator [g] | Washing power [%] (tea) | Washing power [%] (red wine) | Washing power [%] (coffee) | Washing power [%] (spinach) |
|---|---|---|---|---|---|---|
| EXAMPLE 13 | 5.00 | 0.005 | 81 | 94 | 95 | 85 |
| EXAMPLE 17 | 5.00 | 0.050 | 81 | 95 | 97 | 85 |

The results of Table 7 showed that the bleaching performance of COMPARATIVE EXAMPLE 3 was superior to that of COMPARATIVE EXAMPLE 1, and bleaching performance was by far increased by adding phenanthroline manganese complex to this bleaching agent (EXAMPLE 13). The bleaching performance in the case of EXAMPLE 17 was shown to have equal or improved results to those of EXAMPLE 13.

EXAMPLE 18 to 20

Oil Coating of the Surface Activators

After bleaching activator granules synthesized in EXAMPLE 14 were moved into a fluidized bed device, an oil coating process was performed. After the fluidized bed equipment was operated, 600 g of granulated bleaching activator were put into a container while fluidizing with hot air, and coating materials were injected through a spray nozzle at the lower part of a container. The composition, concentration, and detailed reaction conditions of the oil in water emulsion composition used as a coating material are recorded in below Table 8.

TABLE 8

Oil coating conditions

| Classification | | EXAMPLE 18 | EXAMPLE 19 | EXAMPLE 20 |
|---|---|---|---|---|
| Emulsion liquid compositions | Oil constituent | Silicone 100 | silicone 400 | Silicone 200/ carnauba wax |
| | Oil content (wt %) | 10 | 10 | 9.9/0.1 |
| | Emulsifying agent | Soap/polyoxyethylene (20) sorbitan monostearate | | |
| | Content of emulsifying agent (wt %) | 20/0 | 20/2 | 18/2 |
| Solution temperature (° C.) | | 75 | 70 | 65 |
| Infusion inlet temperature (° C.) | | 85 | 85 | 85 |
| Discharging outlet temperature (° C.) | | 30 to 35 | 32 to 36 | 30 to 35 |
| Spray pressure (Kgf/cm$^2$) | | 1.2 | 1.2 | 1.2 |
| Air volume (m$^3$/hr) | | 45 to 55 | 45 | 50 |
| Container pressure (mm/Ag) | | 60 to 70 | 90 to 100 | 65 to 70 |
| Filter pressure (mm/Ag) | | 200 to 240 | 255 to 260 | 210 to 245 |
| Spray infusion rate (g/min) | | 8 to 10 | 9.5 to 11.3 | 10 to 10.7 |
| Operating time (min) | | 10 | 11.5 | 12 |

EXAMPLE 21 to 23

Capsulation of a Bleaching Activator

A capsulation process was continuously performed in the fluidized bed equipment used in EXAMPLE 18 to 20. After the fluidized bed equipment was operated, 600 g of oil coated bleaching activator granules were put into a container and while fluidizing with hot air, capsulated materials were injected through a spray nozzle at the lower part of a container. The types, concentration and detailed reaction conditions of the capsulated materials are recorded in below Table 9.

TABLE 9

| Capsulation conditions | | | |
|---|---|---|---|
| Classification | EXAMPLE 21 | EXAMPLE 22 | EXAMPLE 23 |
| Capsulated materials | soap (sodiumlaurate)/ fatty acid (lauric acid) | polyvinylalcohol | Soluble starch |
| Aqueous solution concentration of capsulated materials (wt %) | 15/5 | 5 | 10 |
| Additives | Fluorescent dye | Fluorescent dye/ zeolite4A/ sodiumchloride | Fluorescent dye/ bentonite |
| Aqueous solution concentration of additives (wt %) | 2 | 2/5/5 | 5/2 |
| Solution temperature (° C.) | 75 | 70 | 65 |
| Infusion inlet temperature (° C.) | 85 | 85 | 85 |
| Discharging outlet temperature (° C.) | 30 to 35 | 33 to 37 | 35 to 39 |
| Spray pressure (Kgf/cm$^2$) | 1.2 | 1.2 | 1.2 |
| Air volume (m$^3$/hr) | 45 to 55 | 40 | 50 |
| Container pressure (mm/Ag) | 60 to 70 | 90 to 100 | 65 to 70 |
| Filter pressure (mm/Ag) | 185 to 220 | 130 to 160 | 205 to 225 |
| Spray infusion rate (g/min) | 10 to 12.1 | 8 to 12.0 | 9.5 to 13.5 |
| Operating time (min) | 90 | 84 | 85 |

EXAMPLE 24 to 29, COMPARATIVE EXAMPLE 4, 5

Storage Stability Evaluation

When those capsulated bleaching activators of the present invention synthesized according to the combinations of the above EXAMPLE 14 to 16, EXAMPLE 18 to 20, and EXAMPLE 21 to 23 were used as bleaching agents or detergent composition constituents, the following active oxygen titration method was performed in order to test a storage stability of a bleaching activator inside the product.

A 0.8 weight parts of detergent base (30 wt % of surfactant, 20 wt % of soda ash, 20 wt % of sodium silicate, 10 wt % of carboxymethylcellulose, 10 wt % of sodium sulfate decahydrate, 10 wt % of tiopal CBS-X), 0.2 wt % of sodium percarbonate, 0.01 wt % of capsulated phenanthroline manganese complex of the present invention were respectively measured and added to a vial.

By storing in a thermohydrostat of a temperature of 40° C. and a relative humidity 80% with the lid on the vial in which a sample was contained opened, remaining active oxygen values for each of composition capsulated bleaching activators or non capsulated bleaching activators according to the present invention (a phenanthroline manganese complex compound was used in a form of dried powder in this evaluation) were measured each hour. Active oxygen values were measured according to the Korean Standard method, and. used reagents and operating methods are described in detail as follows.

Reagent a) Bismuth sulfate manganese solution (Reinhard-Zimmermann Reagent)

A 2 g of $Bi(NO_3)_3$, 4 to 5 g of $MnSO_4$, and 5.5 g of $H_2O$ were dissolved in 1 l of 2.5 M(5N) sulfuric acid, wherein 2.5 M sulfuric acid was produced by adding 139 ml of concentrated sulfuric acid to 1 l of water.

b) 0.02 M $KMnO_4$ solution

Operation a) A 1 g of sample was quantitified accurately by 0.0001 g, put into Erlenmeyer flask, then bismuth sulfate manganic solution was filled so that it could be sufficiently dissolved.

b) While continuously agitating, 0.02 M $KMnO_4$ solution was added to the solution until a pink color was maintained for 30 seconds, and then a volume of active oxygen was calculated according to the below Formula 2.

$$c=A\cdot f\cdot K/(S\cdot 1000)\times 100 \quad \text{[Formula 2]}$$

Wherein the above Formula, c is a volume of active oxygen,

A represents an added amount of $KMnO_4$ (ml), f represents a concentration efficient of $KMnO_4$, S represents a sample weight (g), and K is 0.8 in the case of active oxygen (AO).

The results relatively comparing active oxygen value are represented in the below Table 10.

TABLE 10

| Storage stability evaluation | | | | | | | | | |
|---|---|---|---|---|---|---|---|---|---|
| | Combination | | | | | | | | Residue |
| Classification | Non Capsulated bleaching activator | Capsulated bleaching activator (0.01 g) Granulization | Coating | Capsulation | Detergent (g) | Sodium percarbonate (g) | $KMnO_4$ (ml) | Active oxygen | of active oxygen (%) |
| EXAMPLE 24 | — | EXAMPLE 14 | EXAMPLE 18 | EXAMPLE 21 | 0.8 | 0.2 | 34.20 | 13.68 | 94.6 |
| EXAMPLE 25 | — | EXAMPLE 14 | EXAMPLE 18 | EXAMPLE 21 | 0.8 | 0.2 | 34.60 | 13.84 | 95.7 |
| EXAMPLE 26 | — | EXAMPLE 14 | EXAMPLE 19 | EXAMPLE 21 | 0.8 | 0.2 | 32.59 | 13.03 | 90.1 |
| EXAMPLE 27 | — | EXAMPLE 14 | EXAMPLE 19 | EXAMPLE 21 | 0.8 | 0.2 | 32.91 | 13.17 | 91.0 |
| EXAMPLE 28 | — | EXAMPLE 14 | EXAMPLE 20 | EXAMPLE 22 | 0.8 | 0.2 | 30.78 | 12.31 | 85.1 |
| EXAMPLE 29 | — | EXAMPLE 14 | EXAMPLE 20 | EXAMPLE 23 | 0.8 | 0.2 | 29.91 | 11.97 | 82.7 |
| COMPARATIVE EXAMPLE 4 | 0.01 | — | — | — | 0.8 | 0.2 | 18.25 | 7.30 | 50.5 |
| COMPARATIVE EXAMPLE 5 | 0.005 | — | — | — | 0.8 | 0.2 | 18.01 | 7.21 | 49.8 |

The reason that the amount of a capsulated bleaching activator and that of a non capsulated bleaching activator are different from each other is because these amounts were adjusted so that the same bleaching activators could be contained considering the amount of capsulated material.

As can be seen from results of the above Table 10, half or less of the active oxygen was left in the case where a non-capsulated bleaching activators were applied, while up to 83 to 96% of the active oxygen remained when capsulated bleaching activators were used. Therefore, increasing effects on the storage stability of bleaching agents by capsulating bleaching activators could be seen to be very excellent.

A granulated, oil coated or capsulated bleaching activator of the present invention or a bleaching activator which stabilizes the same has superior effects in increasing the bleaching power of bleaching agents used in laundry, dishwashing, false teeth rinsing, and the fabrics, paper, and pulp industries. A bleaching composition comprising this bleaching activator has a superior bleaching effect even in water of a low temperature.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A bleaching composition comprising 1 to 99 wt. % of sodium percarbonate or sodium perborate and 0.001 to 5 wt % of a bleaching activator increasing the bleaching power of sodium percarbonate or sodium perborate, the bleaching activator comprising a phenanthroline manganese complex comprising one or more compounds selected from the group consisting of $[MnCl_2(phen)_2]$, $[MnBr_2(phen)_2]$, $[Mn(H_2O)_2(phen)_2](SO_4)$, $[Mn(H_2O)_2(phen)_2](ClO_4)_2$, $[Mn(CH_3COO)_2(phen)_2]$, $[Mn^{III}Cl_3(H_2O)(phen)]$, $[(phen)_2Mn^{IV}(\mu\text{-}O)_2Mn^{IV}(phen)_2](ClO_4)_4.H_2O$, $[(phen)_2Mn^{III}(\mu\text{-}O)_2Mn^{IV}(phen)_2](ClO_4)_3.xH_2O$ (x=2 or 4), and $[(phen)(H_2O)Mn^{III}(\mu\text{-}O)(\mu\text{-}CH_3COO)_2Mn^{III}(phen)(H_2O)](PF_6)_2$.

2. A bleaching composition in accordance with claim 1, wherein the said phenanthroline manganese complex is granulated, oil coated, or capsulated.

3. A bleaching activator in accordance with claim 2, wherein the said granulated bleaching activator is manufactured by mixing a) 100 to 1000 parts of binder;

b) 110 to 3000 parts of filler; and c) 100 to 1000 parts of a mixed solution of phenanthroline manganese complex powder and a photo-bleaching agent solution.

4. A bleaching activator in accordance with claim 3, wherein the binder comprises one or more items selected from a group composed of sugar, sodium silicate, polyethyleneglycol, soap, hydroxypropylmethylcellulose, cellulose, Arabian gum, ethyleneoxide based non ionic surfactant, and polyvinylpyrrolidone; the said filler comprises one or more items selected from a group consisting of Zeolite 4A, P, X, L, P omega, zeolone modernite, ZSM-5, F, W, and EDTA; and the said photo bleaching agent solution comprises one or more items selected from a group composed of albumin, gelatin, Arabian gum, agarose, alginic acid, cellulose, celluloseacetatephthalate, methylcellulose, ethylcellulose, hydroxypropylcellulose, polyvinylalcohol, polyvinylpyrrolidone, silicone polymer, soluble starch, dextrin, soap, nonylpenylether, polyethyleneglycol, fatty acid, fatty alcohol, and chitosan.

5. A bleaching composition in accordance with claim 2, wherein the oil coated bleaching activator comprises an oil in water emulsion composition coated on phenanthroline manganese complex granules.

6. A bleaching activator in accordance with claim 5, wherein the said oil in water emulsion composition comprises:

a) 5 to 50 wt % of oil selected from the group consisting of:

i) silicone oil with a of viscosity 100 to 5000 cst;

ii) a mixture of 70 to 99 wt % silicone oil of viscosity 100 to 5000 cst and 1 to 30 wt % silicone oil of viscosity 10000 to 100000 cst;

iii) a mixture of 95 to 99.9 wt % silicone oil of viscosity 100 to 5000 cst and 0.1 to 5 wt % of wax; and iv) oil selected from the group consisting of liquid paraffin, soybean oil, olive oil, and sesame oil;

b) 0.5 to 30 wt % of emulsifying agent; and c) 50 to 95 wt % of water.

7. A bleaching activator in accordance with claim 2, wherein the capsulated bleaching activator comprises 1000 parts by weight of oil coated phenanthroline manganese complex granules coated with 100 to 300 parts by weight of a photo-bleaching agent and a fluorescent dye, a mixture of a water soluble material and a photo-bleaching agent, or a mixture of a water soluble material and a fluorescent dye.

8. A bleaching detergent composition comprising:

a) 1 to 40 wt % of peroxide;

b) 1 to 50 wt % of anion surfactant;

c) 1 to 50 wt % of non ion surfactant;

d) 1 to 70 wt % of builder;

e) 0.1 to 10 wt % of tetraacetylethyleneamine; and f) 0.0001 to 0.5 wt % of bleaching activator comprising a phenanthroline manganese complex comprising one or more compounds selected from the group consisting of $[MnCl_2(phen)_2]$, $[MnBr_2(phen)_2]$, $[Mn(H_2O)_2(phen)_2](SO_4)$, $[Mn(H_2O)_2(phen)_2](ClO_4)_2$, $[Mn(CH_3COO)_2(phen)_2]$, $[Mn^{III}Cl_3(H_2O)(phen)]$, $[(phen)_2Mn^{IV}(phen)_2](ClO_4)_4H_2O$, $[(phen)_2Mn^{III}(u\text{-}O)_2Mn^{IV}(phen)_2](ClO_4)_3xH_2O$ (x=2 or 4), and $[(phen)(H_2O)Mn^{III}(u\text{-}O)(u\text{-}CH_3COO)_2Mn^{III}(phen)(H2O)](PF_6)_2$.

9. A bleaching composition wherein the bleaching composition is a false teeth rinsing agent comprising:

a) 1 to 70 wt % of peroxide comprising one or more compounds selected from the group consisting of urea peroxide, sodium percarbonate, sodium perborate, and calcium peroxide;

b) 0.001 to 10 wt % of bleaching activator comprising a manganese based phenanthroline manganese complex comprising one or more compounds selected from the group consisting of $[MnCl_2(phen)_2]$, $[MnBr_2(phen)_2]$, $[Mn(H_2O)_2(phen)_2](SO_4)$, $[Mn(H_2O)_2(phen)_2](ClO_4)_2$, $[Mn(CH_3COO)_2(phen)_2]$, $[Mn^{III}Cl_3(H_2O)(phen)]$, $[(phen)_2Mn^{IV}(phen)_2](ClO_4)_4H_2O$, $[(phen)_2Mn^{III}(u\text{-}O)_2Mn^{IV}(phen)_2](ClO_4)_3xH_2O$ (x=2 or 4), and $[(phen)(H_2O)Mn^{III}(u\text{-}O)(u\text{-}CH_3COO)_2Mn^{III}(phen)(H2O)](PF_6)_2$; and c) additives comprising a bubbling agent, wetting agent, viscosity increasing agent, and abradant.

* * * * *